US006993815B2

(12) United States Patent
Ferronato

(10) Patent No.: US 6,993,815 B2
(45) Date of Patent: Feb. 7, 2006

(54) APPARATUS FOR UPHOLSTERING COMPONENTS OF CHAIRS, ARMCHAIRS OR THE LIKE

(76) Inventor: Giovanni Ferronato, Via Campo Aviazione 2/A, Casoni di Mussolente (IT) I-36060

( * ) Notice: Subject to any disclaimer, the term of this patent is extended or adjusted under 35 U.S.C. 154(b) by 188 days.

(21) Appl. No.: 10/363,743

(22) PCT Filed: Aug. 31, 2001

(86) PCT No.: PCT/EP01/10060

§ 371 (c)(1),
(2), (4) Date: Mar. 7, 2003

(87) PCT Pub. No.: WO02/20394

PCT Pub. Date: Mar. 14, 2002

(65) Prior Publication Data

US 2004/0098850 A1 May 27, 2004

(30) Foreign Application Priority Data

Sep. 7, 2000 (IT) ..... PO2000A0214

(51) Int. Cl.
*B68G 7/00* (2006.01)

(52) U.S. Cl. ..... 29/91; 29/91.5

(58) Field of Classification Search ..... 29/91, 29/91.1, 91.2, 91.4, 91.5, 91.6, 91.7, 91.8
See application file for complete search history.

(56) References Cited

FOREIGN PATENT DOCUMENTS

| | | | |
|---|---|---|---|
| DE | 3009422 | * | 9/1981 |
| EP | 0 071 693 A2 | | 2/1983 |

* cited by examiner

*Primary Examiner*—John C. Hong
(74) *Attorney, Agent, or Firm*—Browdy and Neimark, PLLC

(57) ABSTRACT

An apparatus (1) is described for upholstering components of chairs, armchairs, or the like, in particular backrests and/or seats having a sandwich structure (11) with a covering layer (12) fitted so as to cover a frame (14) at least partially, the apparatus comprising at least one stapling gun (8), a support table (10*a*) for the sandwich structure (11), means (16) for compressing the sandwich structure (11), and a robotic arm (4) on which the stapling gun (8) is mounted, as well as means for controlling the robotic arm (4), the control means being arranged to guide and operate the stapling gun (8) along a stapling path defined peripherally on the sandwich structure (11).

16 Claims, 3 Drawing Sheets

APPARATUS FOR UPHOLSTERING COMPONENTS OF CHAIRS, ARMCHAIRS OR THE LIKE

TECHNICAL FIELD

The present invention relates to apparatus for upholstering components of chairs, armchairs or the like, according to the preamble to the main claim.

BACKGROUND ART

The invention is applicable to the industrial production of chairs or armchairs which are generally manufactured in several separate components which are subsequently assembled.

A seat or backrest of a chair and/or armchair comprises a support, preferably with a generally plate-like anatomical configuration, associated with a padding, for example, of foam rubber, the support and the padding being covered with a covering layer of fabric, leather or similar material.

One of the steps of the process for the manufacture of the finished chair and/or armchair consists of the assembly of the three elements listed above, forming a sandwich structure, followed by the stapling of the covering to the frame, on the side which is least in view, so that the covering covers the padding layer. According to a known system, this process step is performed manually by stretching the edge portions of the covering over the frame by hand and, at the same time, stapling it by means of a stapling gun.

This technique involves various disadvantages such as the high cost of the labour which is required and difficulty in performing the stapling correctly, whilst avoiding folds or unsightly effects in the covering.

DISCLOSURE OF THE INVENTION

The problem underlying the present invention is that of providing apparatus for covering chairs, armchairs or the like which is designed structurally and functionally to overcome the disadvantages set out above with reference to the prior art mentioned.

This problem is solved by the invention by means of apparatus for covering chairs, armchairs and the like, formed in accordance with the appended claims.

BRIEF DESCRIPTION OF THE DRAWINGS

The characteristics and the advantages of the invention will become clearer from the detailed description of a preferred embodiment thereof, described by way of non-limiting example with reference to the appended drawings, in which.

PREFERRED EMBODIMENT OF THE INVENTION

Figure 4:
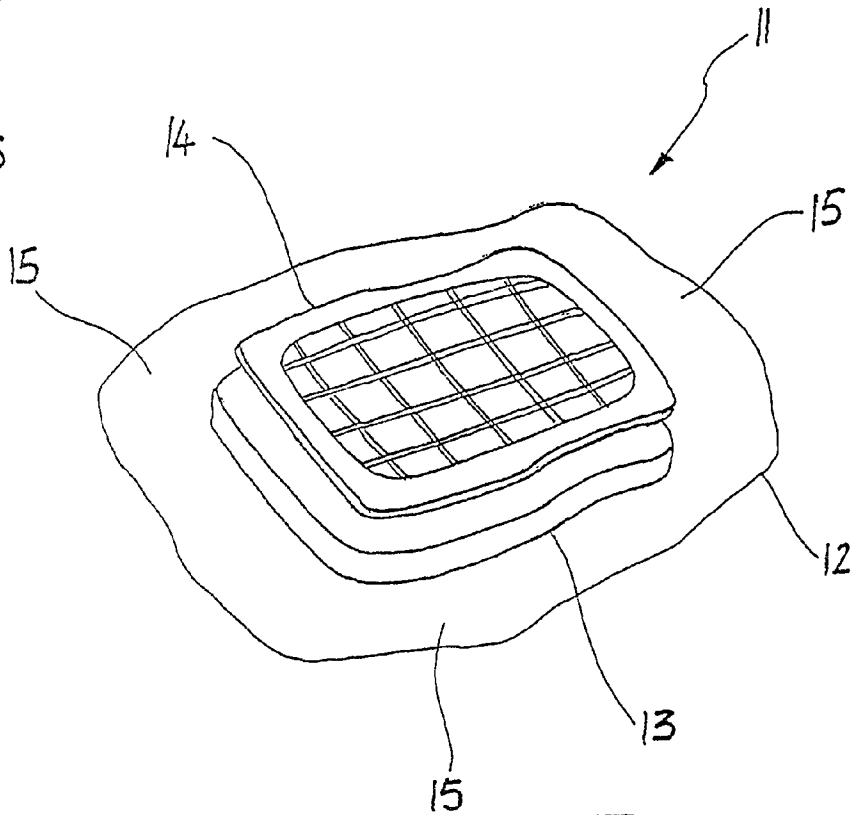
FIG. 4 is an exploded, schematic, perspective view of a sandwich structure which can be processed by the apparatus of FIG. 1.
Figure 1:
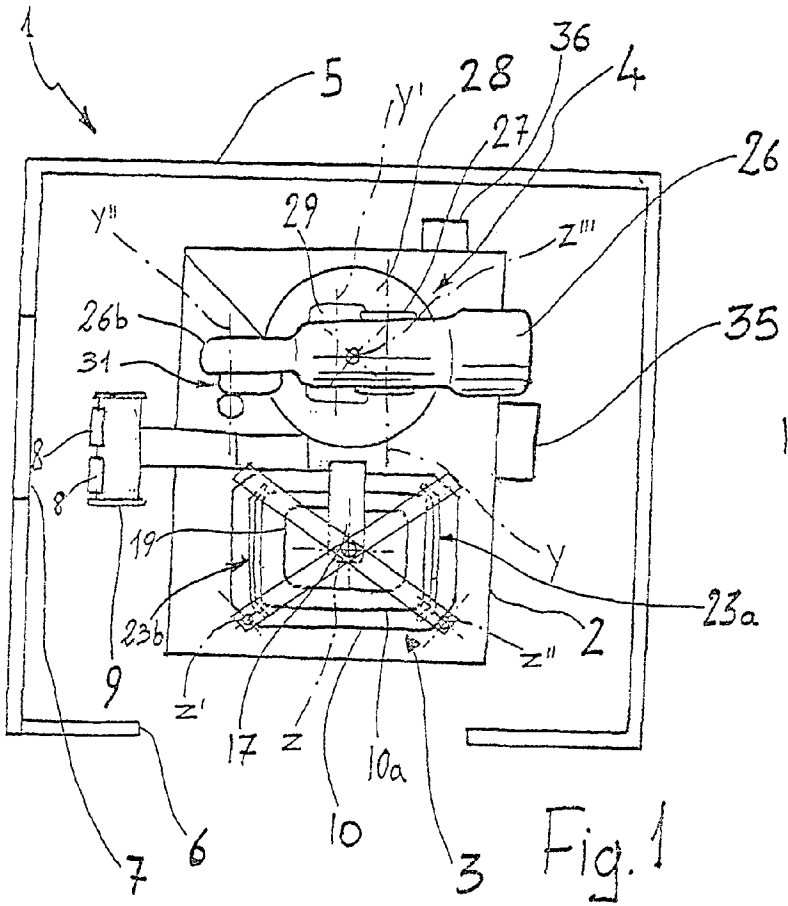
FIG. 1 is a schematic plan view of apparatus, formed in accordance with the present invention, for upholstering components of chairs, armchairs or the like, FIG. 2 is a partial perspective view of the apparatus of FIG. 1.

Apparatus formed in accordance with the invention for upholstering components of chairs, armchairs or the like is generally indicated 1 in FIGS. 1 to 4.

The apparatus 1 comprises a base 2 on which a support structure 3 and a robotic arm 4 are mounted.

A protective casing 5 provided around the apparatus 1 comprises an opening 6 at the front of the support structure 3 and a pivoting door 7 at the side of the support structure 3 for facilitating the reloading of a stapling gun 8. Support means 9 provided in front of the pivoting door 7, inside the area delimited by the protective casing 5, have seats for housing a plurality of stapling guns 8 which can be reached by the operator, by opening the pivoting door 7, in order to perform the loading with suitable staples.

The support structure 3 comprises a platform 10 positioned parallel to the base 2 at a predetermined distance therefrom and supported by three legs 10*b*, 10*c*, 10*d*, fixed to the base 2. A support table 10*a* is defined on the platform 10 for receiving a sandwich structure 11 of a component of a chair or armchair, for example, a backrest or a seat, to be processed.

The sandwich structure 11 comprises a covering layer 12 made of fabric, leather or similar material, a padding element 13, for example, of foam rubber, and a support frame 14 of plastics, wood or metal, preferably of anatomical shape, which are arranged one on top of another. The peripheral shape of the frame 14 and of the padding element 13 are comparable with one another so that, when the frame and the padding element are arranged one on top of the other, the two peripheral profiles correspond to one another, whereas the periphery of the covering layer is larger than those of the above-mentioned two elements so that the peripheral edge portions 15 of the covering layer can be folded over the padding element 13, so as to cover it, and then fixed to the frame 14.

Figure 2:
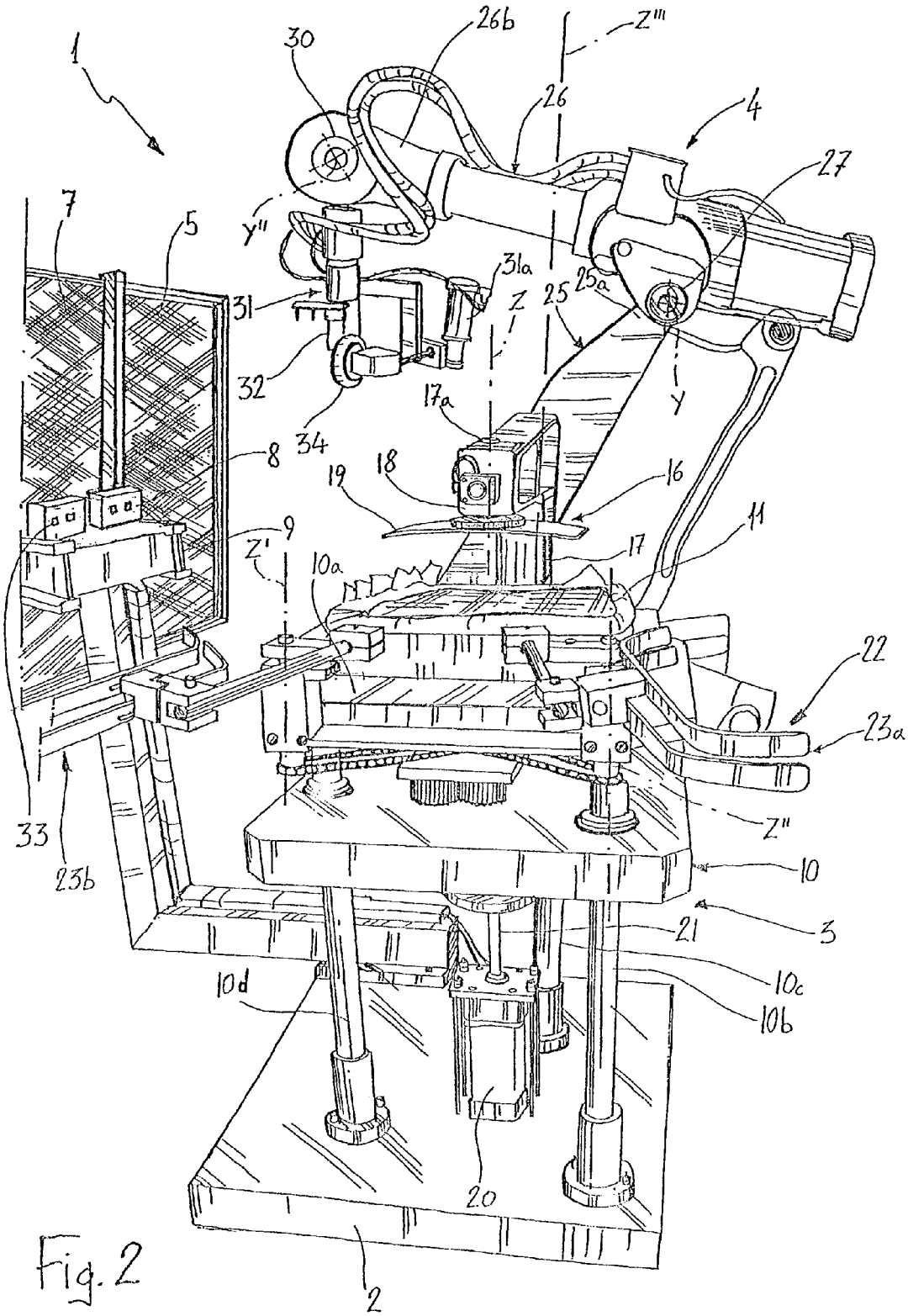
Figure 3:
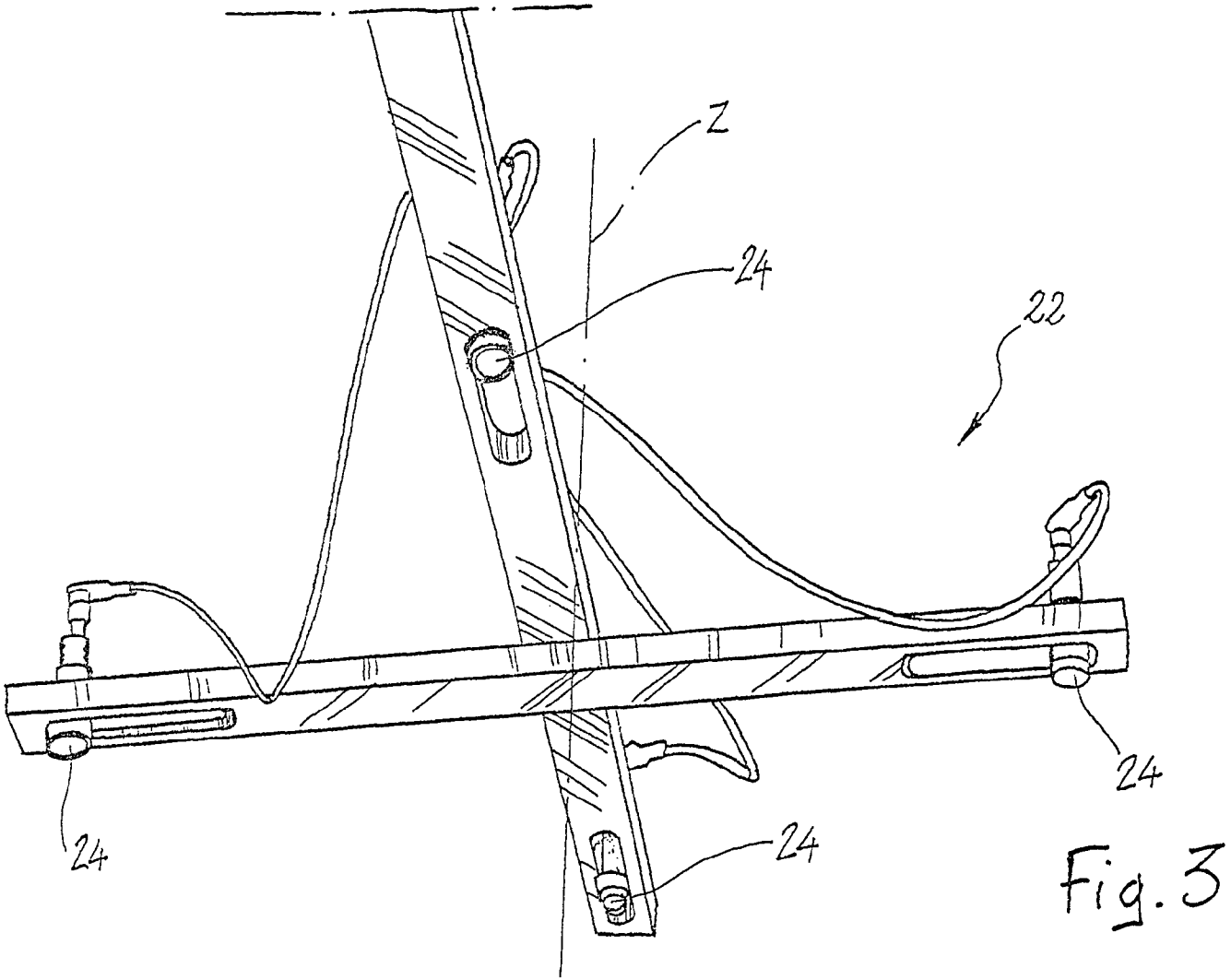
FIG. 3 is a perspective view of a detail of the apparatus of FIG. 1.

The support structure 3 also comprises compression means 16 which comprise a U-shaped element 17 between the two parallel and opposed arms 17*a* of which the support table 10*a* is positioned (only one arm 17*a* is visible in FIG. 2). A pressure element 19 is fixed firmly to one end 18 of one of the two arms 17*a* of the U-shaped element, facing the bearing surface 10*a*.

The U-shaped element 17 can perform a translational movement, relative to a vertical axis Z perpendicular to the support table 10*a*, away from and towards the support table, and a pivoting movement about the same axis. The translational movement is brought about by means of a hydraulic jack 20 which comprises a piston 21 and is fixed, by one end, to the base 2, between the legs 10*b*, 10*c*, 10*d* supporting the platform 10 and, by its other end, to the end of the other of the two arms 17*a* of the U-shaped element 17.

The apparatus 1 also comprises locating means 22 for positioning the sandwich structure 11 correctly. The locating means 22 comprise two arms 23*a*, 23*b* which can be opened out and which are articulated to the platform 10 in a reflectively symmetrical manner, on the side facing the opening 6 in the casing 5. The arms 23*a*, 23*b* which can be opened out can pivot about respective axes Z', Z", parallel to the axis Z, in order to move from a rest position in which they are opened out away from the platform to a locating position in which they are disposed beside the sides of the platform 10 in the space between the pressure element 19 and the support table 10*a*. The arms which can be opened out have a shape such as to correspond to the lateral profiles of the frame 14 and of the padding element 13 and, in the locating position, they thus help to achieve optimal positioning of the sandwich structure 11 on the platform 10 when the structure 11 is positioned thereon for processing.

The locating means 22 also include lamps 24, associated with the support table 10*a,* for projecting luminous sighting beams onto the table 10*a* and to indicate the optimal position for the support of the sandwich structure 11.

The robotic arm 4 is positioned on the side of the platform 10 remote from the opening 6 in the protective casing 5. The robotic arm 4 comprises a rotatable platform 28 which is mounted on the base 2 in order to pivot about an axis Z'" parallel to the axis Z, and two portions 25 and 26 which are connected to one another by means of a first articulation 27. The portion 25 is connected, by one 25*a* of its ends, to the first articulation 27 and, by its other end, to a second articulation 29 positioned firmly on the rotatable platform 28. A third articulation 30 is disposed on an end 26*b* of the portion 26 and a support head 31 is connected thereto.

The first and second articulations 27, 29, however, allow the portions 25, 26 to pivot about two axes Y, Y', which are parallel to one another and perpendicular to the axis Z. The third articulation 30 permits both pivoting of the support head 31 relative to the portion 26 about an axis Y" parallel to the axis Y and pivoting of the support head 31 within a cone of rotation having its vertex at the third articulation.

The support head 31 comprises engagement means 32 for housing and restraining the stapling gun 8, on which respective complementary engagement means, 33 are provided, as well as means 31*a* for the operative control of the stapling gun 8 and a fabric-stretching roller 34 which is motor-driven so as to rotate about its axis.

The robotic arm 4 is controlled by control means comprising a logic unit 35 provided with a monitor, and is operated by motor-driven means 36.

Prior to processing, the apparatus 1 is in the waiting position, that is, the stapling gun 8, which has an internal staple-loader, is positioned on the support means 9, the robotic arm 4 is spaced from the platform 10, the arms 23*a,* 23*b* which can be opened out are in the rest position remote from the platform, and the distance between the support table 10*a* and the pressure element 19 is the maximum permitted.

In order to perform the covering process, the sandwich structure 11 is constructed on the support table 10*a* in the space defined between the table and the pressure element 19, by the arrangement of the various elements of which it is composed one on top of another, through the opening 6 in the casing 5, in the manner described below. The covering layer 12 is placed in contact with the support table 10*a,* and the padding element 13 and then the frame 14 are superimposed thereon. The sandwich structure 11 thus constructed is then positioned correctly on the support table 10*a* by means of the locating means 22, and the arms 23*a,* 23*b* which can be opened out are brought to the locating position to meet the peripheral edge of the sandwich structure. Upon completion of the positioning, the arms that can be opened out are returned to the rest position.

Through a command by the operator, the stapling gun 8 is automatically picked up from the support element 9 by the support head 31 of the robotic arm. At the same time, the pressure element 19 is moved towards the platform 10 by translational movement of the U-shaped element 17 brought about by means of the hydraulic jack 20. The sandwich structure 11 is thus compressed and firmly anchored to the platform 10.

The robotic arm is then moved towards the platform 10 and the support head 31 is placed on the edge of the sandwich structure 11, in the stapling position.

The control means of the robotic arm 4 are arranged to guide and operate the stapling gun 8 along the peripheral edge of the sandwich structure 11; during this movement, the peripheral edge portions 15 of the covering layer 12 disposed beneath the frame 14 are picked up by the fabric-stretching roller 34, by virtue of its rotation about its axis, and at the same time are stretched over the frame 14 thereby. The stapling gun, which is positioned beside the roller 34 in the support head 31, applies the fixing staples to the peripheral edge portions 15 at predetermined intervals, stapling them to the frame 14.

During the rotary movement of the support head 31 around the sandwich structure 11, the inclination of the head 31 to the support table 10*a* is varied to improve the stretching of the peripheral edge portions 15 of the covering layer, particularly at the corners of the frame 14. The stapling is thus performed in an optimal manner.

If the staples in the stapling gun 8 run out, the robotic arm automatically returns the empty stapling gun to the support means 9 and picks up a second stapling gun suitably located thereon, and then returns to the stapling position.

Moreover, during the stapling stage, the U-shaped element 17 pivots through 90° about the axis Z to allow the support head 31 to perform a complete rotary movement around the sandwich structure 11.

When the support head 31 has performed a complete rotary movement through 360°, at the same time completely stapling the covering layer 12 to the frame 14, thus covering the padding 13 and thereby achieving the covering of the chair component in question, the apparatus 1 is returned to the waiting condition and, after the removal of the processed product constituted by the sandwich structure, duly stapled, is made ready for the insertion of the elements necessary for the construction of a second sandwich structure 11.

The invention thus solves the problem posed, achieving many advantages over known techniques.

In particular, the stapling of the chair or armchair component is performed in automated manner, reducing the labour required to produce the finished part. The stapling itself is performed with considerable precision and accuracy by virtue of the flexibility and multiplicity of the movements which can be performed by the robotic arm. The time required to perform the entire assembly and the stapling is considerably reduced.

What is claimed is:

1. Apparatus (1) for upholstering components of chairs, armchairs, in particular backrests and/or seats, comprising:

a sandwich structure (11) with a covering layer (12) fitted so as to cover a frame (14) at least partially;

at least one stapling gun (8);

a support table (10*a*) for the sandwich structure (11);

and means (16) for compressing the sandwich structure (11); the apparatus being characterized in that:

the sandwich structure (11) is positioned on the support table (10*a*) with the covering layer (12) placed in contact with the support table (10*a*) and with the frame superimposed thereon;

it comprises a robotic arm (4) on which the stapling gun (8) is mounted and means for controlling the robotic arm (4), the control means being arranged to guide and operate the stapling gun along a stapling path defined peripherally on the sandwich structure (11);

a rotatable platform (28) which can rotate about an axis (Z'") and to which the robotic arm (4) is connected by means of a first articulation (29); and a fabric-stretching roller (34) associated with the robotic arm (4), the roller being motordriven so as to act on the covering layer (12) which is gripped between the roller (34) and the frame (14) in a tensioned state, prior to stapling; the peripheral edge portions of the covering layer being stretched over the frame (14) by the fabric-stretching roller.

2. Apparatus according to claim 1, comprising means (22) for locating the sandwich structure (11) on the support table (10*a*).

3. Apparatus according to claim 2, in which the locating means (22) comprise arms (23*a*, 23*b*) which can be opened out and which can be moved, relative to the support. table (10*a*), from a position for locating the sandwich structure (11).

4. Apparatus according to claim 2, in which the locating means (22) comprise lamps (24) for projecting sighting beams, the lamps being associated with the table (10*a*) in order to project at least one locating beam onto the table (10*a*).

5. Apparatus according to claim 3, in which the locating means (22) comprise lamps (24) for projecting sighting beams, the lamps being associated with the table (10*a*) in order to project at least one locating beam onto the table (10*a*).

6. Apparatus according to claim 1, in which the robotic arm (4) comprises a first portion (25) and a second portion (26), connected to one another by a second articulation (27).

7. Apparatus according to claim 1, comprising a support head (31) connected to the robotic arm (4) by means of a third articulation (30) and in turn comprising means (32) for the engagement of the stapling gun (8) and means (31*a*) for the operative control of the stapling gun (8).

8. Apparatus according to claim 6, in which the first and second articulations (29, 27) are arranged for pivoting of the first and second portions (25, 26) with respect to parallel axes (Y, Y').

9. Apparatus according to claim 8, in which the parallel axes (Y, Y') are perpendicular to the axis of rotation of the rotatable platform (Z'").

10. Apparatus according to claim 7, in which the fabric-stretching roller (34) is supported on the support head (31).

11. Apparatus according to claim 7, in which the third articulation (30) is arranged for pivoting of the support head (31) about an arbitrary axis within a cone of rotation having its vertex at the third articulation (30).

12. Apparatus according to claim 1, in which the compression means (16) comprise a U-shaped element (17) comprising two parallel and opposed arms (17*a*) between which the support table (10*a*) is positioned.

13. Apparatus according to claim 12, in which the compression means (16) comprise a pressure element (19) fixed to one end (18) of one of the arms (17*a*) of the U-shaped element (17), facing the support table (10*a*).

14. Apparatus according to claim 12, in which the U-shaped element (17) can be translated towards or away from the support table (10*a*).

15. Apparatus according to claim 12, comprising a hydraulic jack (20) for bringing about the translation of the U-shaped element (17).

16. Apparatus according to claim 1, comprising support means (9) for a plurality of stapling guns (8) which can be replaced on the robotic arm (4) in turn.

* * * * *